United States Patent [19]

Sturm et al.

[11] 4,099,548

[45] Jul. 11, 1978

[54] HAND-HELD PIPETTE FOR REPETITIVELY DISPENSING PRECISE VOLUMES OF LIQUID

[75] Inventors: Ronald Leo Sturm, San Carlos; James Curtis Smith, Hayward, both of Calif.

[73] Assignee: Oxford Laboratories Inc., Foster City, Calif.

[21] Appl. No.: 717,744

[22] Filed: Aug. 25, 1976

[51] Int. Cl.[2] ..... B65B 3/12

[52] U.S. Cl. ..... 141/27; 73/425.6; 128/218 C; 222/318; 222/391; 417/435

[58] Field of Search ..... 141/18, 25–28, 141/2, 89–92; 417/435; 128/218 P, 218 R, 218 C, 234, 236, 214 R, 215; 73/425.6, 425.4 P; 222/318, 391

[56] References Cited

U.S. PATENT DOCUMENTS 3,790,048 2/1974 Luciano et al. ..... 222/391

FOREIGN PATENT DOCUMENTS 1,519,772 2/1968 France ..... 222/391

*Primary Examiner*—Houston S. Bell

*Attorney, Agent, or Firm*—Limbach, Limbach & Sutton

[57] ABSTRACT

A hand-held pipette with a liquid dispensing knob at one end operably connected therewithin to a piston and piston cylinder assembly at the opposite end that is detachable from the pipette body for cleaning or replacement. An internal pawl and rack mechanism causes the piston to advance a small amount each time the knob is pressed, thereby repetitively dispensing small volumes of liquid therefrom. A second knob cooperatively engages an internal mechanism for both urging the piston to an overshoot position within the piston chamber and to disengage the piston from the internal mechanism in the pipette housing.

17 Claims, 29 Drawing Figures

HAND-HELD PIPETTE FOR REPETITIVELY DISPENSING PRECISE VOLUMES OF LIQUID

BACKGROUND OF THE INVENTION

This invention relates generally to pipettes and more particularly to pipettes of the repetitive liquid dispensing type.

Hand-held liquid dispensing pipettes have become very popular in recent years for use in laboratories in conducting chemical tests. A principal use of such devices is in medical and clinical laboratories wherein precise volumes of liquid and a specimen under test need to be mixed together. Such a pipette includes a piston cylinder and a piston sealed thereto. An end of the pipette that is in fluid communication with the piston cylinder is submersed in the liquid to be transferred, a precise volume drawn up, usually in a detachable tip, this liquid being discharged by the pipette into another container. Such liquid transfer pipettes are illustrated in U.S. Pat. Nos. RE 27,637; 3,855,867; 3,918,308 and 3,882,729.

Another type of pipette in use in chemical and medical laboratories is one wherein a volume of liquid is drawn into the pipette and thence a known portion of that volume is dispensed each time the pipettor knob is depressed. Such a repetitive dispenser type of pipette is described in U.S. Pat. No. 3,161,323, a device substantially as shown in that patent having been sold by the assignee thereof for many years. A similar device is being manufactured and sold by Unimetrics Universal Corporation of Anaheim, California.

It is a principal object of the present invention to provide an improved pipette of the liquid dispensing type capable of accurate liquid volume dispensing and which is convenient to use.

SUMMARY OF THE INVENTION

Briefly, and very generally, the pipette according to the present invention includes the use of a rack and pawl mechanism, wherein the rack is advanced an incremental distance each time a knob at one end of a pipettor body is depressed. The rack is attached to a piston that reciprocates at the other end of the pipettor body in a liquid receiving piston cylinder. A separate knob is provided on the pipettor for withdrawing the piston from the piston cylinder to draw liquid thereinto when it is desired to fill the device. A mechanism is provided within the pipette so that that same second knob can also drive the piston to an overshoot position when it is desired to minimize the volume of the piston chamber, a desirable condition when first filling the piston chamber with liquid. A mechanism is also provided for the same second knob to disengage the connection between the rack and the piston which, in combination with a release mechanism for the piston cylinder, permits removal of the piston and piston cylinder assembly for cleaning or replacement.

Various objects, advantages and features of the various aspects of the present invention are given in the following description of a preferred embodiment of a pipette incorporating the various aspects of the present invention. This description should be taken in conjunction with the accompanying drawings.

DESCRIPTION OF THE PREFERRED EMBODIMENTS

Figure 1:
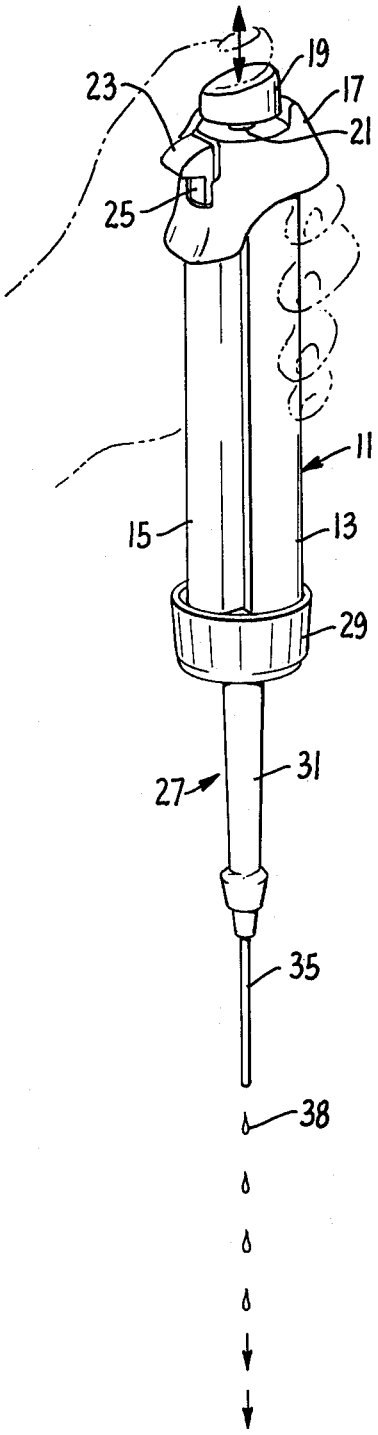
FIG. 1 illustrates the use of a pipette incorporating the present invention for repetitive discharge of liquid therefrom.
Figure 2:
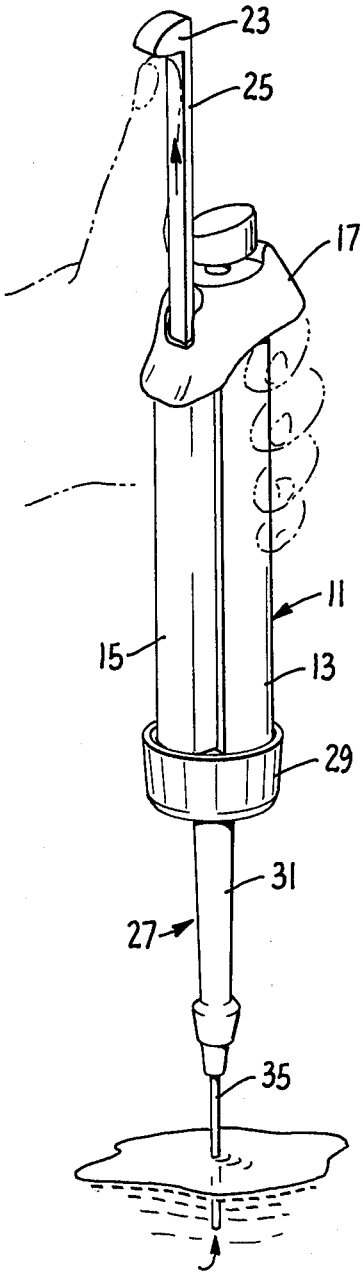
FIG. 2 illustrates filling with liquid the pipette shown in FIG. 1.
Figure 3:
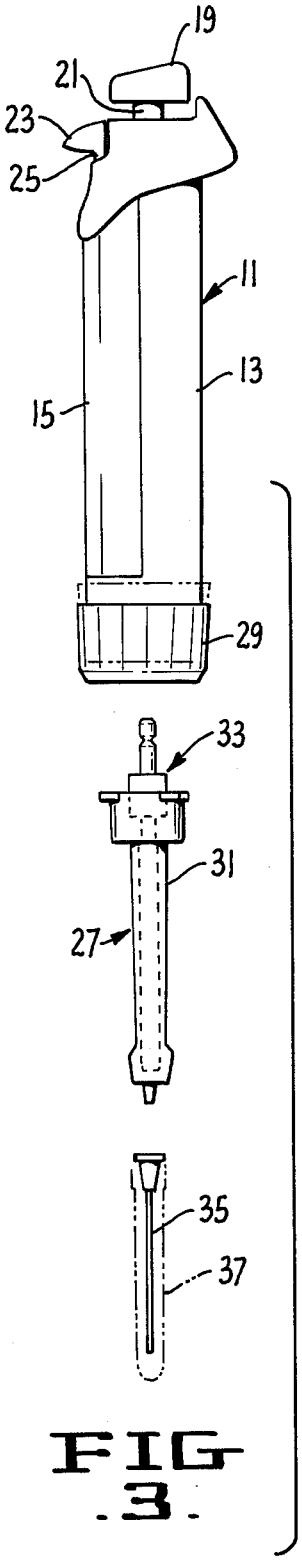
FIG. 3 illustrates the readily detachable components of the pipette shown in FIGS. 1 and 2.

With reference principally to FIGS. 1–3, the overall operation of a pipette embodying the various aspects of the present invention will be described. A pipette body or housing 11 is formed of a main housing portion 13 and a spring clip cover 15. These two components form an elongated pipette housing which may be easily gripped on its outside by a human hand and which on its inside contains most of the operating parts of the pipette. A handle cap 17 is provided at one end of the pipette housing. A piston advance knob 19 is attached to a pawl rod 21 which extends into the pipette. A separate load slide knob 23 is attached to a loading slide 25 which also extends into the interior of the pipette for performing various operations described hereinafter.

A piston assembly 27 is removably attached to another end of the pipette body 11 by means of a piston assembly release collar 29 that is threadedly attached to the other end of the pipettor body 13. The piston assembly 27 includes as major components a piston cylinder 31 having a cylindrical inside surface. A piston rod assembly 33 slides back and forth within the piston chamber 31. A needle 35 is removably attached to a free end of the piston cylinder 31. Such tips are commercially available and are usually provided in a sanitary cover 37.

The general operation of the device is described with respect to FIGS. 1–3. When liquid exists within the piston cylinder 31, a desired volume of liquid, such as a drop 38, is discharged from the needle 35 by depressing the knob 19 once fully downward until a positive stop is felt. The knob 19 spring returns to its normal position and another drop of liquid may be obtained by again pressing the knob 19 in a similar manner. When the piston assembly 33 is driven as far down within the piston chamber 31 as it will go, the piston chamber 31 must again be filled with liquid, as shown in FIG. 2. By pulling up the loading slide 25, through its knob 23, the piston rod assembly 23 is withdrawn from the piston chamber 31 into the pipette body 11 and liquid is thus drawn in through the needle 35. When the pipettor 11 is to be used with a different liquid, the piston assembly 27 is detached and either cleaned or a new one attached to the pipette body 11.

Figure 4:
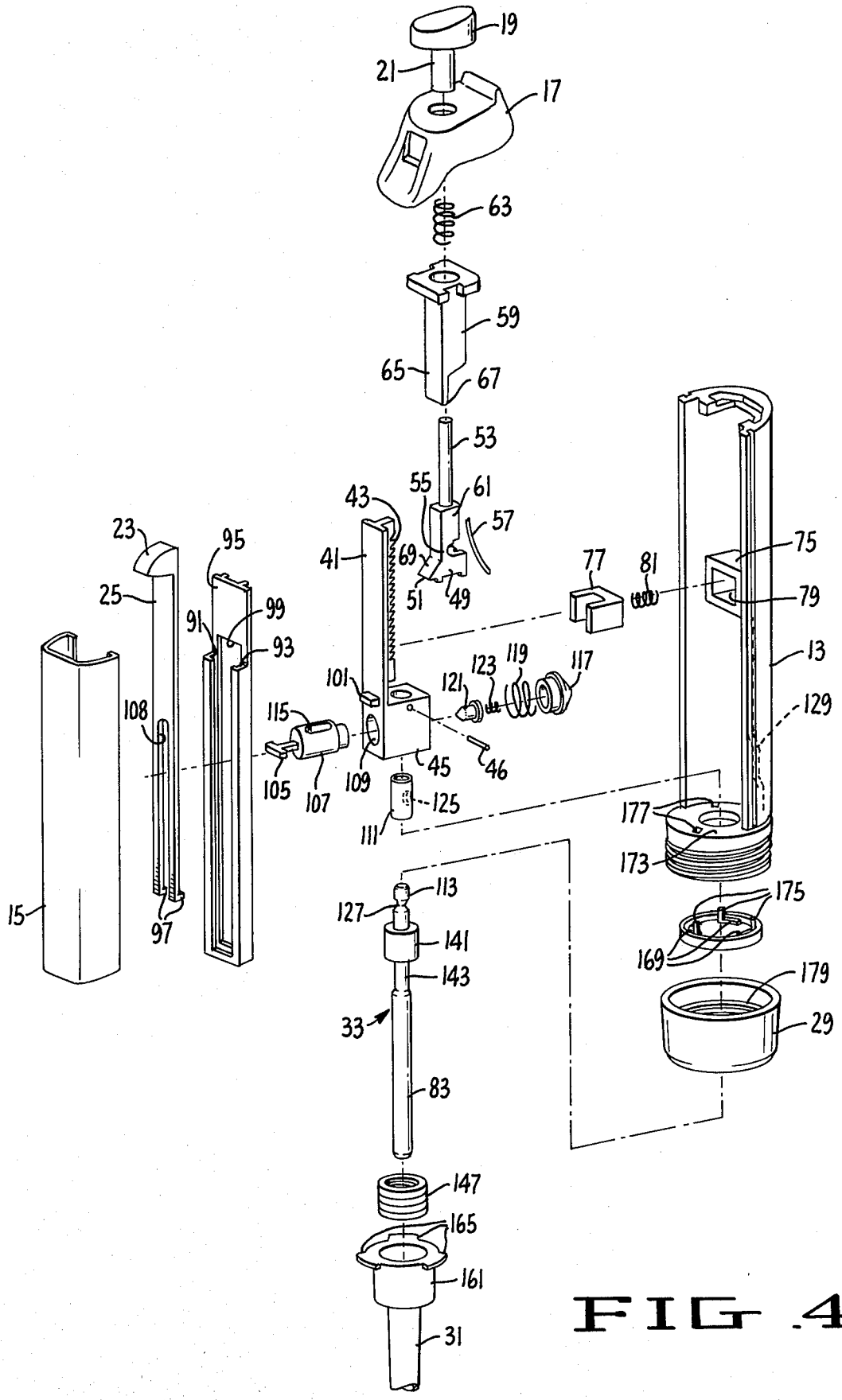
FIG. 4 is an exploded view of the internal construction of the pipette according to FIGS. 1–3.

The internal structure of the pipette 11 which makes possible the incremental liquid dispensing and liquid filling will now be described, principally with respect to FIGS. 4 and 5. A central internal component is a rack support slide 41 that carries a rack 43 on one side thereof. At one end of the rack support slide is a connecting block 45 which permits detachable connection of the piston rod assembly 23 thereto, as described in more detail hereinafter.

A pawl 49 having a rack tooth engaging point 51 is attached to a rod 53 which in turn is attached to the rod 21 of the knob 19. The pawl 49 is hinged at a point 55 which is made to be a thinly molded plastic region that easily bends the limited amount required for operation of this device. A cantilever spring 57 normally urges the pawl 49 to rotate about its hinge 55 so that the point 51 engages one of the teeth of the rack 43.

A pawl guide 59 is held fixed with respect to the pipette body 13 and contains an aperture through which the rods 21 and 53, and an upper portion 61 of the pawl 49, slide back and forth. A spring 63 is included within the pawl guide 59 in order to normally urge the top abrupt edge of the upper portion 61 of the pawl 49 into engagement with a mating ledge 65 (FIG. 5) of the pawl guide 59. Its rest position as urged by the spring 63 is shown in FIG. 5. The pawl guide 59 is oriented so that the back and forth sliding path of the rod 53 and pawl assembly 49 is parallel to the sliding path of the rack support slide 41.

Figure 6:
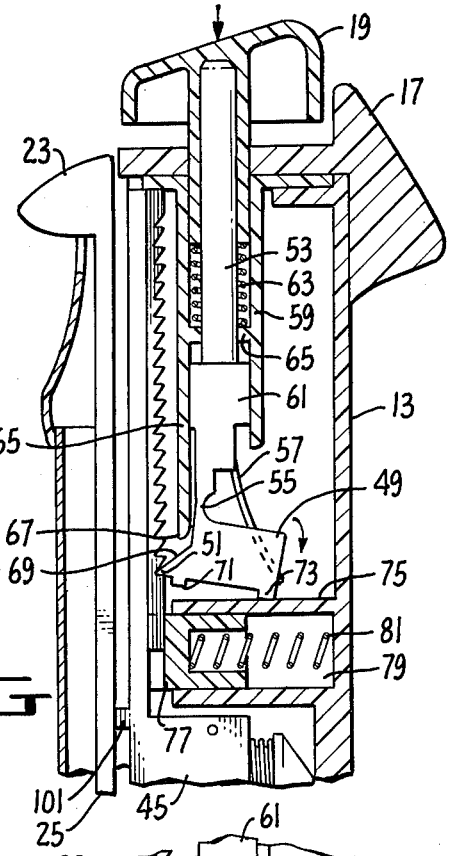
FIGS. 6, 7 and 8 each show, in enlarged view, the upper portion of the internal components of the pipette as shown in FIG. 5 but in various different positions.
Figure 7:
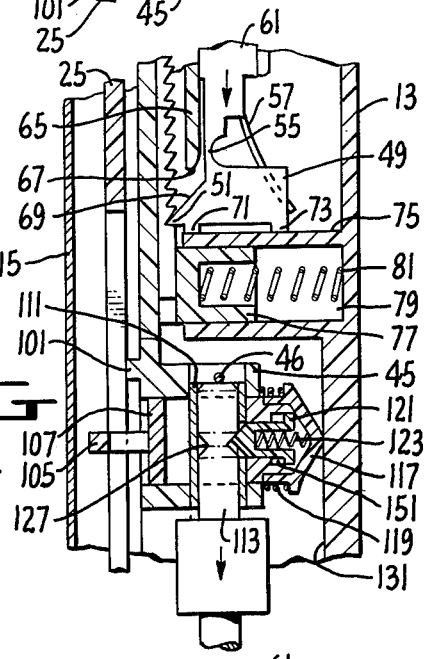

In between these two parellel sliding paths is a dividing wall 65 that is part of the pawl guide 59. An end surface 67 of the wall 65 serves as a cam for the pawl 49. An underside surface 69 of the pawl 49 rides over the cam surface 67 as a cam follower and is urged thereagainst by the leaf spring 57. The shape of the underside 69 and the shape and position of the cam surface 67 are such that the rack engaging point 51 of the pawl 49 is normally disengaged from the rack 43, a position shown in FIG. 5. But when the knob 19 is depressed, the pawl 49 rotates about its hinge 55 and over the cam surface 67 into engagement with the rack 43 to move the rack a distance until feet 71 and 73 abut against a stop wall 75, as shown in FIGS. 6 and 7. The pawl 49 is desirably shaped so that it, with the aid of the cantilever spring 57, contacts the wall stop 75 first with its foot 73, as shown in FIG. 6. The foot 73 is the furtherest removed from the rack 43. As a result, further urging of the pawl 49 against the wall stop 75 so that its foot 71 strikes the wall causes the rack to advance the desired increment without it sliding back upwards. This upward movement is an undesirable possibility that could result if the foot 71 were to first strike the wall stop 75.

Figure 8:
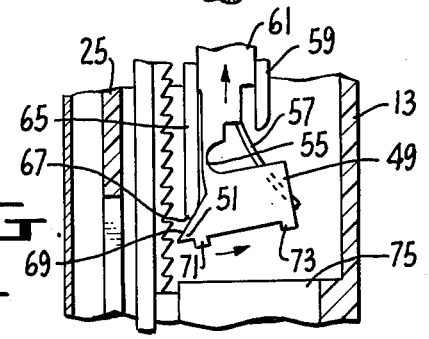
Figure 9:
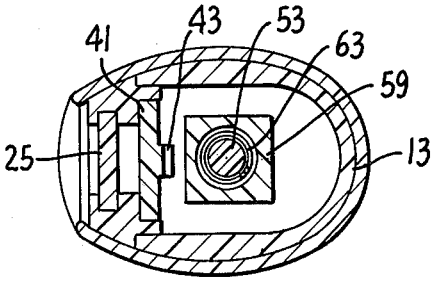
FIGS. 9, 10, 11, 12, 13 and 14 show sectional views of the pipette of FIGS. 1–8 taken, respectively, at sections 9—9, 10—10, 11—11, 12—12, 13—13 and 14—14 of FIG. 5.
Figure 10:
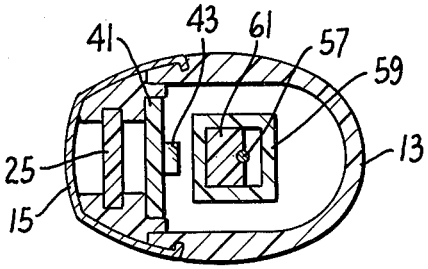
Figure 11:
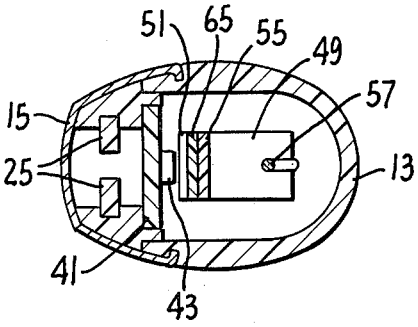
Figure 12:
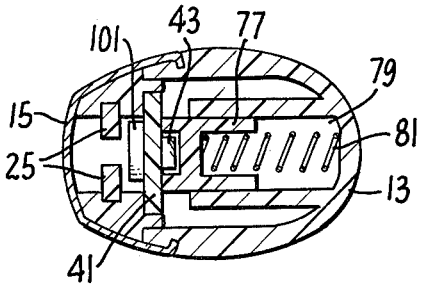

Once the knob 19 has been urged as far downward into the pipette body 13 as permitted by the wall stop 75, as shown in FIG. 7, a release by the operator of the knob 19 causes the entire pawl driving assembly to be returned by its spring 63 to a rest position, as shown in FIG. 8. So that the small drag force caused by the pawl 49 being removed from the rack 43 does not cause it to move upward, a rack puck 77 is slideably held by a puck retainer 79 and is resiliently urged by a spring 81 against the rack support slide 41. By prohibiting any undesired movement of the rack in an upward direction either upon engagement or disengagement by the pawl has an advantage of discharging a volume of liquid from the piston chamber 31 having a higher degree of accuracy and repeatability.

As can be noticed from FIGS. 5–8, a single depression of the knob 19 causes the rack support slide 41 to move only a small distance. This causes a cylindrical piston 83, as a portion of the piston rod assembly 33, to move further downward through a fluid seal 85 into the piston chamber 31 to discharge through an opening 87 at an end of the piston chamber 31 a desired small volume of liquid. A needle lock adapter 89 formed as part of the end of the piston chamber 31 permits attachment of a commercially available needle 35. The internal passage of the needle 35 is caused to align with the passage 87 of the tip adapter 89. Thus, it is in fluid communication with the piston cylinder 31.

Figure 15:
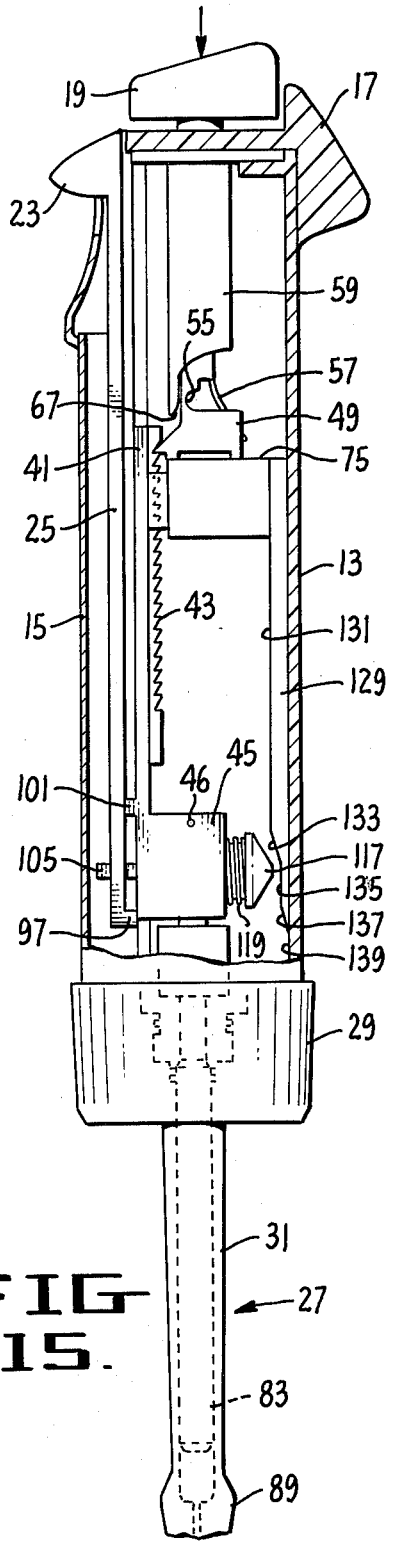
FIGS. 15 and 16 illustrate certain principal components of the pipette of FIGS. 1–14 in two different positions.
Figure 16:
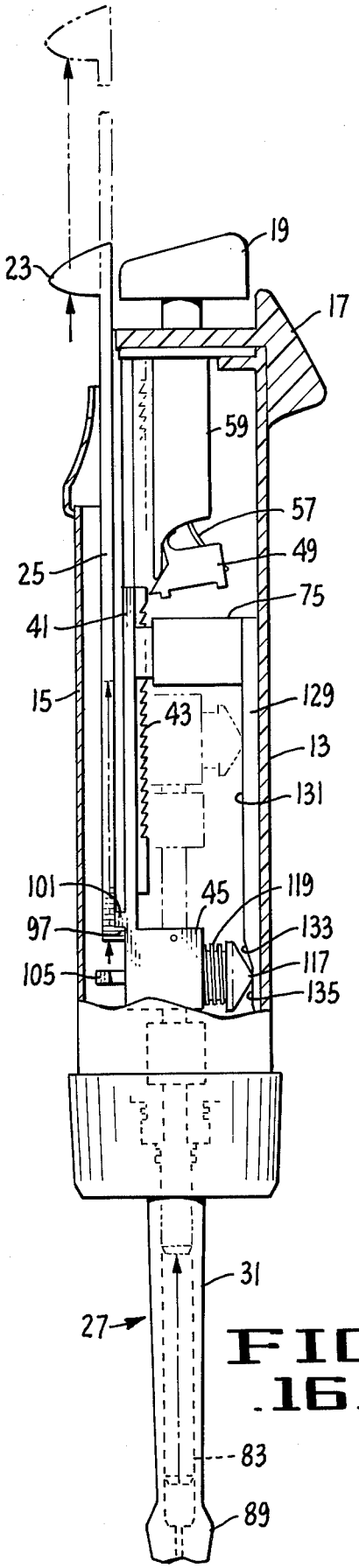

After twenty-five or so individual discharges of a precise volume of liquid through the needle 35, the rack support slide 41 is driven downward as far as the pawl 49 can drive it. This position is shown in FIGS. 15 and 16. The structure for drawing the piston 83 upward out of the piston chamber 31 to again fill it with liquid, as previously discussed with respect to FIG. 2, will now be described with principal reference to FIGS. 4, 5, 15 and 16. The loading slide is caused to slide back and forth within slots 91 and 93 of a rack guide 95. The loading slide 25 has orthogonal projections 97 at its end removed from the knob 23. The projections 97 ride within a rectangular opening 99 that runs along the length of the rack guide 95. The rack support slide 41 includes a piston withdrawal pin 101 that also is positioned within the slot 99. The rack support slide 41 is held to slide back and forth against an outside surface of the rack guide 95 by a force exerted by puck 77 and spring 81. When the loading slide 25 is thus pulled upward out of the pipette enclosure 13, the projections 97 thereon engage the underside of the pin 101 and pull the rack support slide (and thus the attached piston rod assembly 33) upward as shown clearly in FIG. 16. If the needle 35 is submersed in liquid, as is shown in FIG. 2, such action thus causes additional liquid to be drawn into the needle and piston cylinder 31. Since the projections 97 and pin 101 provide a one way connection between the loading slide 25 and rack support slide 41, the loading slide 25 may be returned to its rest position after filling, as shown in FIG. 5, by depressing the loading slide knob 23 downward as far as it will go into the pipette body 11.

As another feature of the pipette, the loading slide 25 can also be utilized when the rack support slide 41 is in a certain position, to urge the rack support slide 41 downward to cause the piston 83 to go into an "overshoot" position. By "overshoot" is meant that the rack support slide 41 and its connected piston 83 are driven further downward than the pawl 49 and its associated assembly can drive it. Such an overshoot position is useful in filling the piston cylinder 31 with liquid, as described hereinafter.

A second pin 105 extending outward of said connecting block 45 that is part of the rack support slide 41 gives an abuttment which the underside of the projections 97 of the loading slide 25 can be urged against. But so that the pin 105 is not in the way of the rod 25 as it is returned to the rest position shown in FIG. 5 after loading, the pin 105 is permitted to extend both through a slot 108, that runs along a large portion of the length of the loading slide 25, and the slot 99 of the rack guide 95. The pin 105 serves in its abutting position if the loading slide 25 is withdrawn upward in a manner permitting the pin 105 to pass out the open end of the slot 108 at an end of the loading slide 25. But the pin 105 will still only be placed in a position for abutting the end of the projections 97 of a downwardly travelling slide 25 if the mechanism within the connecting block 45 permits such movement.

The mechanism within the connecting block 45 will now be described, with principal reference to FIGS. 4, 7 and 13. The pin 105 is rigidly connected to an end of a cam follower holder 107 that is held to reciprocate back and forth within an aperture 109 of the connecting block 45. The aperture 109 is substantially perpendicular to the path of travel of the rack support slide 41 as it moves back and forth in operating the pipette. A sleeve 111 fits over an extreme rod end portion 113 of the piston rod assembly 33, that combination being received by an aperture in the bottom of the connecting block that passes through the passage 109 and substantially perpendicular thereto. The combination of the sleeve 111 and rod end portion 113 also fits within an oval opening 115 of the cam follower holder 107. The opening 115 orients pin 105 perpendicular to the rack slide 25. A stop pin 46 passing through the aperture of the block 45 serves to provide for accurate positioning of the piston rod 33 by abuttment thereagainst at the piston rod end 113.

Rigidly attached to an end of the cam follower holder 107 opposite to that of the pin 105 is a cam follower 117. A spring 119 is captured between the cam follower 117 and a side of the connector block 45, thus urging the entire cam follower and cam follower holder unit in a direction toward the right as shown in the drawings. Within a hollow portion of the cam follower 117 is a plunger 121 urged to the left in these drawings by a spring 123. The plunger 121 is urged through an opening 125 into a V-notch receptacle 127 of the piston rod assembly end portion 113. The plunger 121 is pointed to match the shape of the groove 127. But it is preferable that an edge of the plunger 121 contact the upper edge of the groove 127 to hold the rod end 113 snuggly against the stop pin 46, rather than the point of the plunger 21 fully seating in the groove 127. This assures secure connection of the piston rod 33 to the block 45 without any relative movement therebetween. The groove 127 is formed completely around the outside circumference of the otherwise cylindrically shaped rod portion 113 so that the plunger 121 may seat in the groove without being dependent on the rotational position of the piston rod assembly 33.

Figure 13:
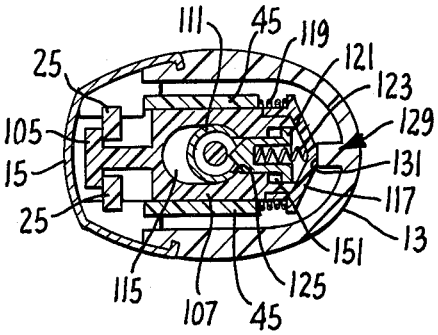
Figure 14:
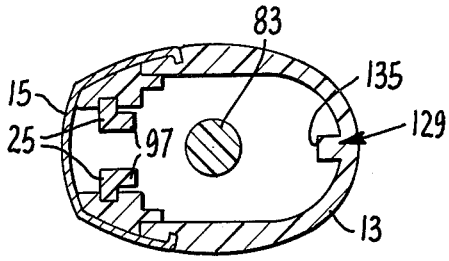

As can best be seen from FIG. 13, the oval shape of the opening 115 in the cam follower holder 107 permits the holder 107 to slide a distance back and forth between extreme positons of abutting against the sleeve 111 on opposite sides thereof at the ends of the opening 115. The cam follower holder position is controlled by a cam 129 that is attached within the housing 13 in a direction along the pipettor length. The cam follower 117 is urged against the cam surface 129. Controlled lateral motion of the cam follower holder 107 and cam follower 117 is thus achieved as a function of the lateral position of the rack support slide 41 along the length of the pipette.

Figure 5:
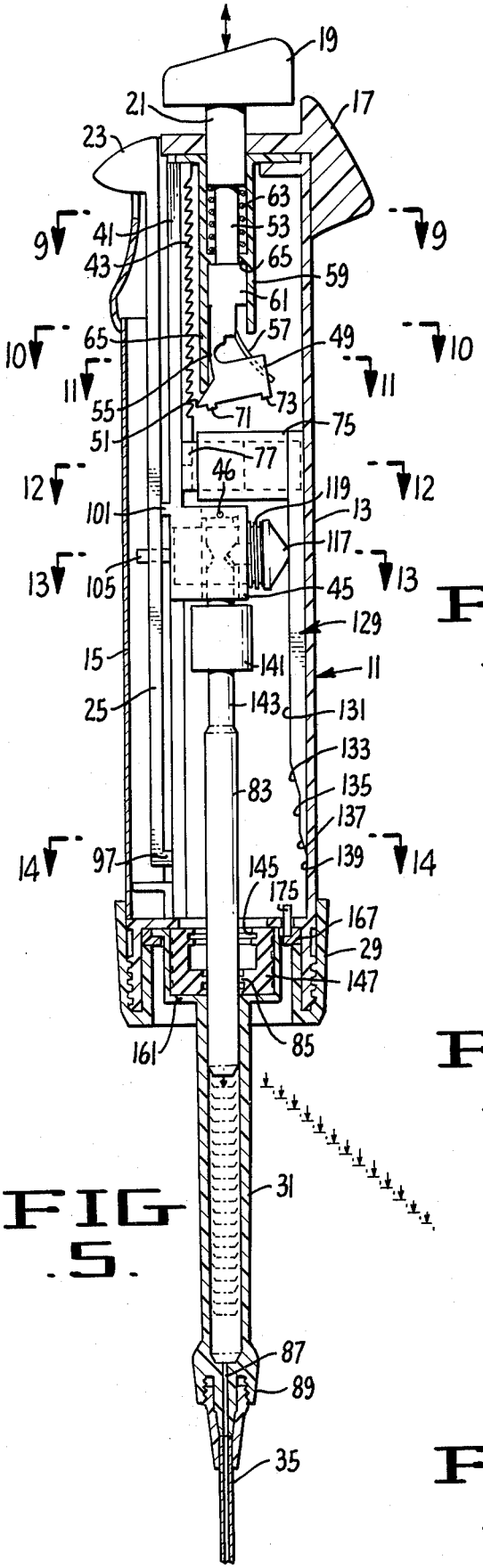
FIG. 5 is a sectional view taken along the length of the pipette of FIGS. 1–4.

The particular shape of the cam 129 can be seen most completely by reference to FIG. 5, although the cam is also shown in each of the FIGS. 15–22. A first innermost cam surface length 131 extends for most of the liquid discharge cycle of the device. A transition surface 133 smoothly connects the surface 131 with a second major cam surface 135 that is removed a distance further than the surface 131 from the path of motion of the rack support slide 41. Another transition section 137 leads to yet a further and third major cam surface 139 at the bottom of the pipettor.

Figure 19:
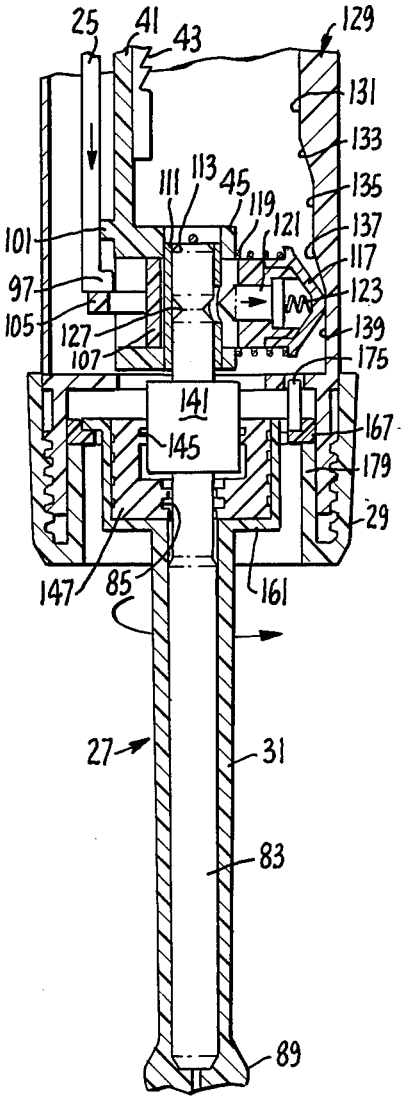

The rack support slide 41 can be viewed as having three distinct operating positional ranges extending from its uppermost position adjacent the knob end of the pipette body, as shown in FIG. 5, to its lowermost piston assembly releasing position, as shown in FIG. 19. Each of these segments of its operation and an explanation as to how the cam assembly takes on different positions in each of these three segments will now be described. The first segment of movement of the rack support slide 41 may be termed its "liquid discharge range" which extends from the position shown in FIG. 5 to the rack support slide 41 position shown in FIG. 15. The slide 41 is moved by the pawl assembly under the control of the push buttom 19 through this range from the top to the position shown in FIG. 15. Any further movement of the rack support slide 41 is accomplished by operation of the loading slide 25 through its knob 23. As shown in FIG. 16, the rack support slide, and thus its attached piston assembly, can be withdrawn by engagement between the projections 97 of the loading slide 25 and the pin 101 on the backside of the rack support slide 41. This operation is illustrated in FIG. 16 where, if a tip attached to the end of the piston assembly is submersed in liquid, liquid will be drawn into the piston cylinder 31 during this operation. This filling is utilized when exactly the same liquid is to be dispensed subsequently. If a different liquid is to be dispensed by the device, a different loading procedure is followed as described hereinafter with respect to FIG. 22.

Figure 17:
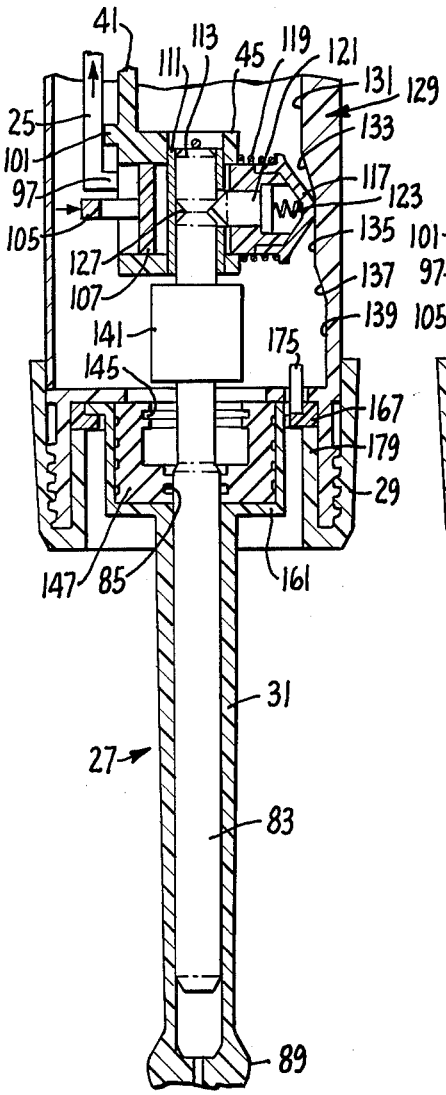
FIGS. 17, 18, 19, 20, 21 and 22 show a sectional view of the lower portion of the pipette of FIGS. 1–16 with the internal components in various different positions.

It will be noted from the positions of the components shown in FIG. 15 that the cam follower 117 does not contact any surface of the cam 129. That is because movement of the cam assembly within the block 45 is restrainted against the resiliency of the spring 119 by the pin 105 engaging the backside of the loading slide 25. But because the cam surface segment 135 is displaced to the right from the cam surface segment 137, a removal of the loading slide 25 so that its end projections 97 pass by the pin 105 causes the cam assembly to snap to the right to a position limited by the cam surface 135. This latter position is shown in FIGS. 16 and 17. The pin 105 is then in a position to be abutted by the bottom of the loading slide 25 and driven through its second major segment of travel, which may be termed the "overshoot range," of the rack support slide 41. The knob 23 is then pushed downward into the pipette body until a firm resistence is felt which is an abuttment of the position 83 with the bottom of the piston chamber 31. In this position, the tip of the cam follower 117 is just leaving the cam surface 135 and entering the transistion section 137 of the cam 129.

Figure 22:
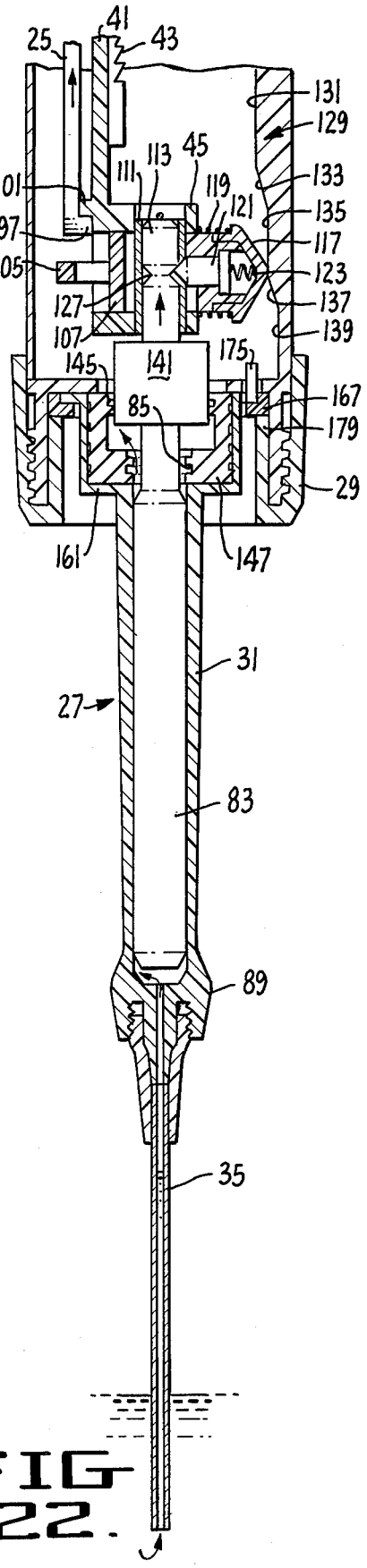

One function of the "overshoot range" of the slide 41 is to permit miminization of dead air space within the piston cylinder 71 and tip 35 when filling an empty cylinder with liquid for the first time. This will occur when the pipette is used with a different liquid than before, since cleaning of the piston assembly will have to occur, or when the piston assemblies are exchanged in a manner described hereinafter. Referring principally to FIG. 22, such a filling operation is described wherein once the slide 41 is urged by downward force against the pin 105 to its extreme overshoot position, it is raised upward again by engagement of the projections 97 of the loading slide 25 to the pin 101 of the slide 41. The filling operation is aided by an automatic air purging system comprised of the two different diameter but concentrically held piston segments 83 and 141 that are connected by an intermediate cylindrical segment 143 having a smaller diameter than the diameter of the major piston 83. The circular seal opening 85 is provided to form a fluid tight seal to the piston 83 and a second circular seal 145 is provided for fluid tight seal to the outside of the larger cylindrical piston segment 141. The seals 85 and 145 are formed as part of a unitary seal boot 147 constructed of a soft, resilient material.

For accuracy of liquid discharge, it is desired that all of the air be removed from the cylinder 31 and tip 35 prior to beginning the liquid discharge operation with the pipette. The operation of the differential piston structure illustrated in automatically purging the air from the cylinder 31 without a separate operation necessary is described in detail and claimed in co-pending patent application entitled "Liquid Dispenser With Means for Automatically Purging Air Therefrom During Liquid Loading" filed by Ronald Leo Sturm and James Curtis Smith concurrently herewith and assigned to the same entity as the present application. Briefly, and particularly with reference to FIG. 22 herein, a large piston 141 is sized to draw air out of the piston cylinder 131 so that as the piston 83 moves upward and just makes a seal with its seal 85 that all of the air has been drawn therefrom. Further upward movement of the rack support slide 41, and thus its attached piston 83, to the extreme rest position at the beginning of its "liquid discharge range" as shown in FIG. 5 causes the piston cylinder 31 to become filled with liquid.

Figure 18:
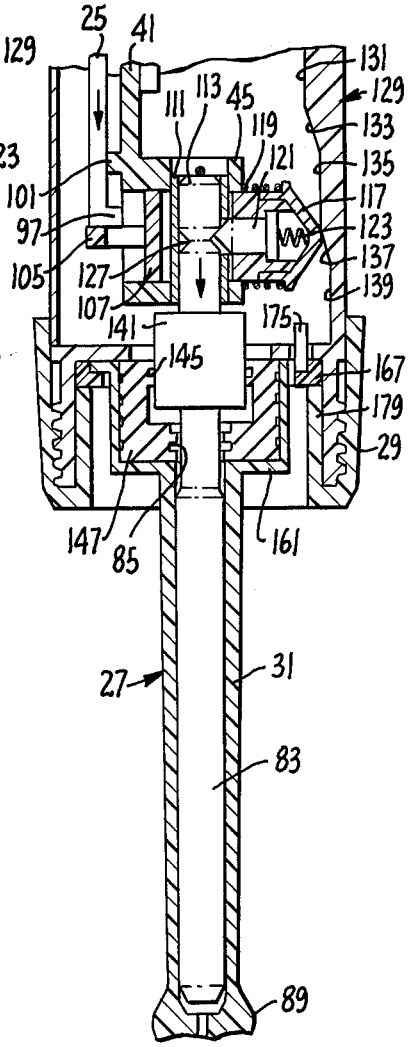

It will be noted principally from reference to FIG. 18 that when the rack support slide 41 is in its "overshoot range" that although the cam assembly has moved to the right from its previous position during most of its "liquid discharge range" and has resulted in the pin 105 being placed in position for downward operable movement by the slide 25, the plunger 121 still engages the slot 127 to hold the piston rod assembly 33 in place. This is accomplished, as can be seen best from FIGS. 7 and 13, by providing a space 151 when the cam follower 117 is riding upon the furthest left positioned cam surface segment 131. This space 151 disappears, as can be seen in either of FIGS. 17 or 18, when the slide 41 is at the bottom of its liquid discharge range or driven into its overshoot range. Any further movement to the right of the cam follower 117 and its attached cam follower holder 107 will cause the plunger 121 to become disengaged from the notch 127 of the piston rod assembly end 113. This is shown in FIG. 19. In order to overcome the positive abuttment that is felt against the piston cylinder 31 at the bottom of the overshoot range, the piston assembly release collar 29 on the outside of the bottom of the pipette body is unthreaded to permit movement downward of the piston cylinder 31. The collar 29 is permitted to rotate only one full turn, without disengagement, to effect this release. This removes the stop and permits the loading slide 25 to urge, through the pin 105, the slide 41 downward even further through its third range, which may be referred to as the "piston disengagement range."

Figure 20:
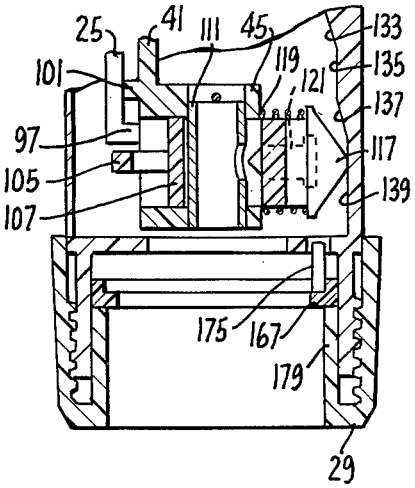
Figure 21:
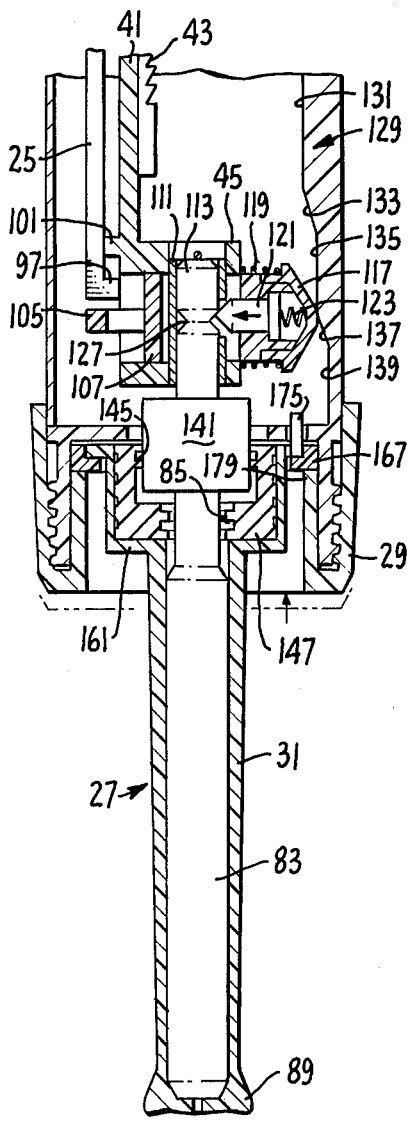
Figure 27:
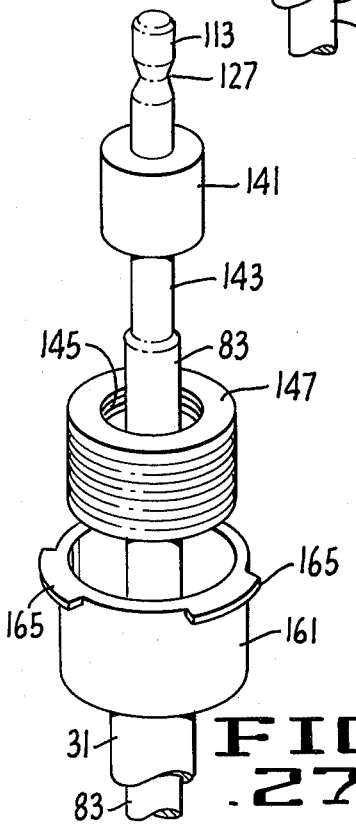
FIGS. 27 and 28 illustrate different sized piston assemblies usable with the pipette of FIGS. 1–26.
Figure 28:
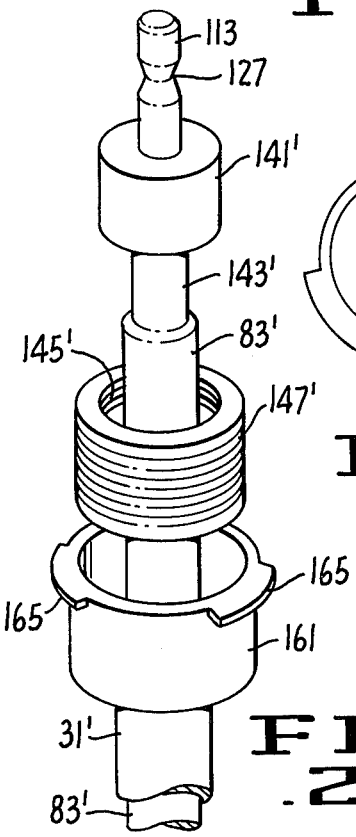
Figure 26:
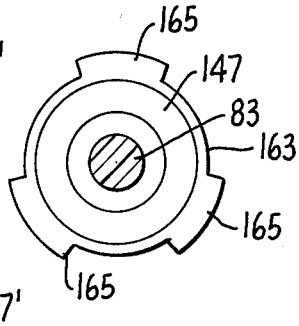

Once the piston rod assembly 33 is disengaged from its connection with the block 45, the piston cylinder 31 itself is disengaged from its connection to the outside of the bottom of the housing 13 by rotation in a manner explained thereinafter. The result after removal of the piston assembly 27 is shown in FIG. 20. The piston assembly 27 may be cleaned or a new piston assembly inserted in a manner shown in FIG. 21, wherein retightening of the collar 29 causes the block 45 and rack support slide 41 to return to the bottom of the overshoot position whereby liquid may be loaded therein in a manner previously described with respect to FIG. 22. The piston assembly described is illustrated in prospective in FIG. 27 and it should be noted with reference to FIG. 28 that the same pipette body may accept a piston and piston cylinder assembly having a larger diameter for different volumes of liquid discharge each time the knob 19 is depressed.

Referring principally to FIGS. 23–26, the structure permitting easy rotational release of the piston chamber 31 from the pipettor body is described for the removal of the entire piston assembly 27 therefrom. An upper end of the piston assembly 31 has an enlarged portion 161 for receiving the sealing boot 147. A free end of the cylindrical portion 161 is terminated with surfaces in a plane perpendicular to an axis of the cylinder 31. In that plane is an outer circular portion 163, having a center of curvature coincident with the axis of the cylinder 31, and three externally extending flanges 165 extending therefrom. Each of the flanges 165 also has an outer circular surface with a center of curvature coincident with the axis of the cylinder 31 and are equally spaced around the circular extremity 163 to provide spaces therebetween. Each of the flanges 165 terminates along a radial line having a center at the axis of the cylinder 31.

A mating component to the piston cylinder flanges is a washer 167 having internally extending flanges 169. These flanges extend inward from a circular ring having an internal circumferential surface 171. The internally extending flanges are adapted for fitting between the flanges 165 of the piston cylinder 31. These cooperatively shaped flanges provide a mating so that when the flanges 165 of the piston cylinder 31 are pushed through the spaces between the flanges 169 of the washer 167, a relative rotation between the parts 31 and 167 will cause the flanges 165 to lie on top of the flanges 169. To facilitate such engagement, the flanges 169 are sloped on a leading edge thereof for easy rotation.

The washer 167 is held at the lower end of the pipettor body 13 beneath a bottom end plate 173 of the pipette. The washer 167 is held adjacent that end plate 173 in a non-rotatable manner by positioning of a plurality of washer posts 175 within correspondingly positioned apertures 177 in the bottom pipette plate 173. As can be seen best by comparing FIG. 18 with either FIGS. 19 or 20, an upper internal cylindrical portion 179 of the collar 29 clamps the washer 167 upward against the bottom of the plate 173 with the piston cylinder flanges 165 forced therebetween. This occurs when the collar is tightly threaded on the bottom of the pipette housing. When it is loosely threaded for disengagement of the piston assembly 27 from the pipette body, as shown in FIGS. 19 and 20, the washer 167 is still loosely retained. The washer 167 is held against rotation with respect to the pipette body but yet is permitted axial movement for removal and insertion of the piston cylinder flanges 167 therefrom.

It will be noted that when the piston assembly 27 is installed it is automatically self centered onto the end of the pipettor body 11 by the construction outlined above. The aperture in the block 45 into which the end 113 of the piston rod assembly 33 is placed automatically positions the enlarged portion 161 of the piston cylinder and its flanges 165 in a position so that the piston portion 83 is properly centered within the piston cylinder 31. This is, of course, of great advantage in preventing binding of the piston 83 to the cylinder 31.

Figure 29:
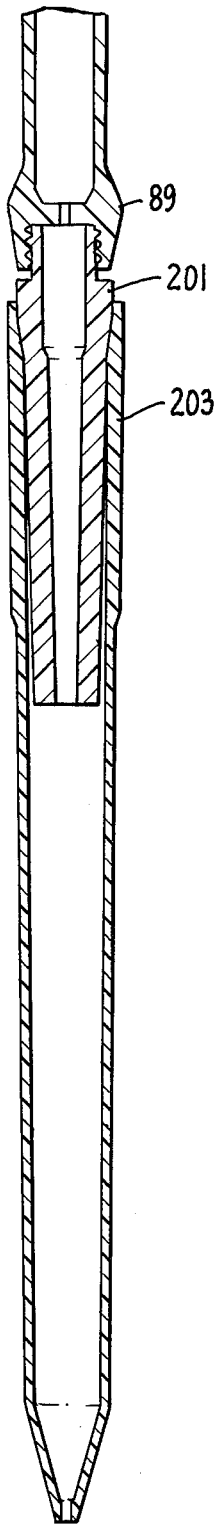
FIG. 29 illustrates a variation of the pipette of FIGS. 1–28.
Figure 23:
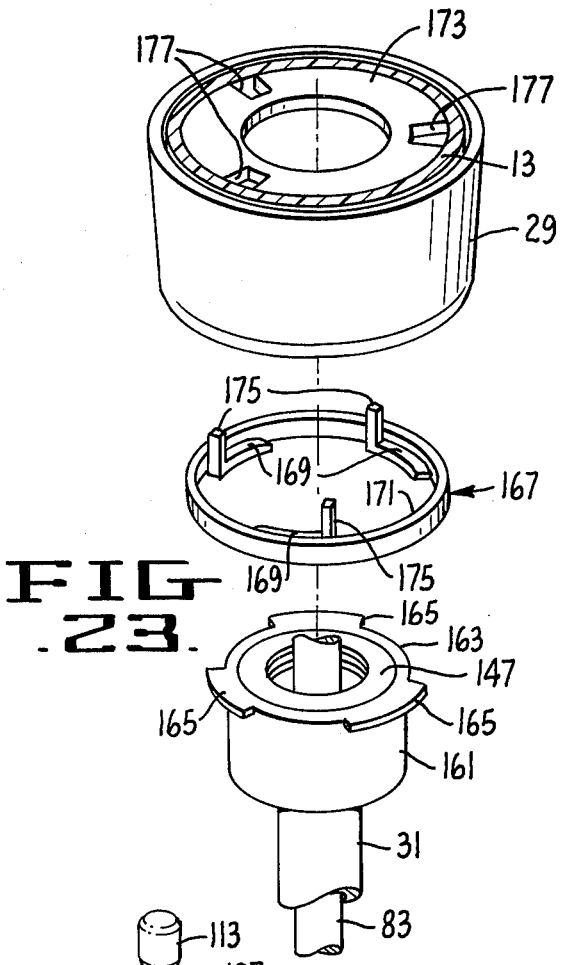
FIG. 23 shows and exploded view of a few of the components of the pipette of FIGS. 1–22.
Figure 24:
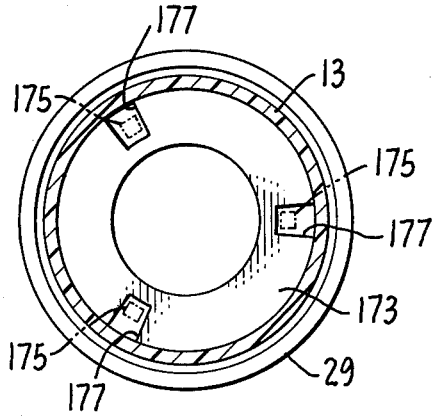
FIGS. 24, 25 and 26 each show the top view of each of the three components illustrated in exploded view in FIG. 23.
Figure 25:
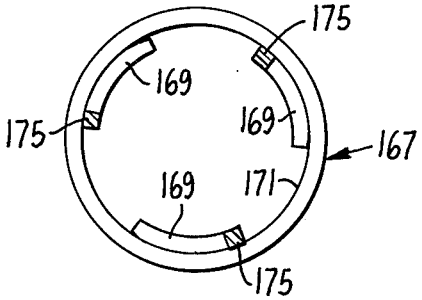

Referring to FIG. 29, a substantial modification of the use of the pipettor described with respect to FIGS. 1–28 is illustrated. Instead of a tip 35 being attached to the adapter 89 at the lower end of the pipette 11, an alternative member 201 is shown attached thereto. The cylindrically shaped member 201 is designed for receiving a standard pipette tip 203 by frictional engagement on its outside. The tip 203 is chosen to be large enough to hold all of the liquid therein to be dispensed, rather than having the liquid drawn into the piston cylinder 31 and in contact with the piston portion 85. The accuracy and repeatability of the liquid volumes dispensed by this technique is not as great as those dispensed by using the device as previously described since in the embodiment of FIG. 29 there is an air interface between the piston 85 and the liquid dispensed. This air interface is subject to compression. However, in many applications the high degree of accuracy permitted by the device is not necessary and the convenient use of standard, disposable pipette tips 203 is preferable. By using such tips, the piston cylinder assembly will need cleaning less often since liquid does not protrude thereinto.

Although the various aspects of the present invention have been described with respect to a preferred pipette embodiment, it will be understood that the invention is entitled to protection within the full scope of the appended claims.

We claim:

1. A pipette having an interrelated mechanism for drawing liquid thereinto, repetitively dispensing a plurality of small quantities of liquid therefrom between fillings, and disengaging part thereof, comprising:

an elongated housing having first and second ends, an elongated slide held for reciprocation along a path within said housing in a direction of its length, a fluid chamber positioned at said first housing end and having an opening for dispensing and drawing fluid therethrough in response to the fluid volume of said chamber being altered, means for altering the fluid volume of said chamber, means within said housing for operably connecting said volume altering means to said elongated slide, means within said housing and responsive to a first external knob at the second housing end for incrementally advancing said slide from a beginning adjacent said second housing end in a direction toward said first housing end to a maximum first knob advanced position within said housing, said slide being advanced a small fraction of its total travel each time said external knob is depressed, thereby to incrementally reduce the volume of said fluid chamber each time said first knob is depressed and thus to displace a desired volume of fluid through said chamber opening, means within said housing non-integral with said slide and responsive to a movement of a second external knob in one direction with respect to said housing for returning said slide to its said beginning position adjacent said second housing end, thereby to increase the fluid volume of said chamber when said second knob is moved in said one direction and thus to draw fluid thereinto through said chamber opening, means within said housing non-integral with said slide and responsive to movement of the second knob in another direction with respect to the housing for moving said slide beyond its said maximum first knob advanced position in a direction toward said first housing end, thereby to reduce the fluid volume of said fluid chamber to a minimum not possible with said first knob, connecting means at said first housing end for disengaging said fluid chamber therefrom, and means as part of said connecting means between the slide and volume altering means that is responsive to the simultaneous disengagement of said chamber by said connecting means and to further movement of said second knob in said another direction beyond its minimum fluid chamber volume position for disengaging said fluid volume altering means from operable connection with said slide, whereby said fluid chamber and volume altering means can be removed from the pipette housing for cleaning or replacement.

2. The pipette according to claim 1 which additionally comprises:

a cam surface contained within said housing and oriented along its length, a cam follower slidably held to said slide in a manner to follow any changing position of the cam surface, and resilient means attached to said cam follower normally urging it against said cam surface.

3. The pipette according to claim 2 wherein said means for moving said slide beyond its maximum first knob advanced position in a direction toward said first housing end, comprises:

a pin operably connected to said cam follower assembly and extending from an opposite side of said slide than does the cam follower, said cam surface having a position throughout nearly all of the slide distance between its beginning position and said maximum first knob advance position that causes said pin to be positioned out of the way of engagement with the second external knob control mechanism, the portion of said cam surface contacted by the cam follower changing to a second position when said slide is at about said maximum first knob advance position that aligns said pin in the path of said second external knob mechanism for further movement toward said first end of the pipette housing until a positive abutment is encountered.

4. The pipette according to claim 3 wherein said fluid volume altering means disconnecting means additionally comprises:

a third cam surface position beginning at about when said slide is urged to a positive abutment, said third cam surface position permitting said cam follower to move even further away from said slide but without removing said pin from the path of said second external knob mechanism, means for removing the abutment to permit said slide to be moved further downward upon operation of said second external knob, and means including a plunger as part of said cam follower mechanism for normally engaging said volume altering means when said cam follower contacts the cam surface in either of its first two positions but disengaging said volume altering means when said cam follower contacts the cam surface in its third position.

5. The pipette according to claim 1 wherein said elongated slide includes a linear rack attached thereto as part thereof, and further wherein said means for incrementally advancing said slide comprises:

a rod held within said housing and constrained to move back and forth in a straight line parallel to and adjacent to the path of said slide, said first knob being attached to one end of said rod external of said housing, a resilient element within said housing normally urging said rod in a direction outward of said housing a distance limited by a stop, a pawl hingedly attached within the housing to the other end of said rod and adapted for normally engaging a tooth of said rack for moving the rack in response to depression of said knob toward said housing, means attached as part of said housing for providing an abutment of an end of said pawl, a cam surface attached to the housing in a position between the rod and the slide for causing said pawl to pivot about its hinge away from said rack when said rod is in its resiliently urged rest position but which guides said pawl into engagement with said rack as said knob is depressed.

6. The pipette according to claim 1 wherein said fluid chamber is detachably connected to said first housing end by a connecting structure that comprises:

a plurality of circular flange segments arranged around an outside circular end surface thereof and having spaces therebetween, said flange segments lying in a plane, and means held against rotation to the first end of said housing but axially movable with respect thereto for clamping said fluid chamber flange segments to the first end of the housing, said clamping means including a ring with a maximum inside diameter sufficient to receive the fluid chamber circular flange segments therethrough and said ring additionally comprising internally extending circular flanges having a radial extent and shape to fit in the spaces between the flanges of the fluid chamber assembly, whereby said fluid chamber assembly is installed by moving its external flanges into spaces between the internally extended circular flanges of said clamping member, rotating the fluid chamber assembly to place its flanges in position between said first housing end and said clamping member internally extending flange members, and then urging said clamping member against said first housing end to securely hold the piston flanges against the pipette housing.

7. A repeating pipette having an interrelated mechanism for handling liquid and controlling connection of disengageable portions thereof, comprising:

a housing, a piston cylinder having a cylindrical axis and having an opening at one end thereof for liquid movement therethrough in both directions into and out of said cylinder, a cylindrical piston with one end thereof held for sliding back and forth within said piston cylinder from its other end, a first slide within said housing oriented to slide back and forth substantially in a path that is parallel to the axis of the piston cylinder, means within said housing and responsive to a first external knob for incrementally advancing said first slide a small distance upon each depression of said first knob from an extreme first slide rest position located furthest from said piston cylinder to a first position toward said cylinder, a second slide within said housing oriented to move back and forth in a path immediately adjacent that of said first slide on one side thereof and substantially parallel thereto, said second slide terminating at one end thereof in a second knob outside of said housing, thereby to permit manual movement of said slide, a connecting block formed as part of said first slide at an end closest to said piston cylinder, said block including an aperture for receiving a free end of said cylindrical piston, and a cam follower assembly slidable substantially orthogonal to the path of travel of said slide, a piston withdrawal pin provided on said slide a distance from said block that permits said second slide through a hook at its end removed from said second knob for returning said first slide to its said extreme rest position, whereby liquid may be drawn into said piston cylinder through said passage, a piston advance pin attached to said slidable cam follower mechanism that is extenable from said first slide in a direction to be engaged by the hook portion of said bottom slide for urging said first slide overshoot distance further towards said cylinder until motion is stopped by abutment of said piston rod with said piston cylinder, a cam provided within the housing of said pipette on the other side of said first slide and over a distance travelled by said block, said cam mechanism within said block being resiliently urged for one end thereof to follow the shape of said cam as the first slide is moved, said cam being shaped so that said piston advance pin is held out of the path of said second slide from its rest position almost to said first position, wherein the cam shape changes just before the first slide reaches its said first position to move said piston advance pin into a position where it may be abutted by said second slide for urging said first slide further in a direction toward said piston cylinder to an overshoot position, means releasing said piston cylinder from said housing a distance to permit movement of said first slide as limited by abutment of the piston and said piston cylinder assembly in a direction further thereto towards from said overshoot position, and means as part of said cam slide within said block for detachably engaging said piston rod for connection therewith, said cam shape and said engagement structure being such that as said first slide is moved toward said piston cylinder in a direction beyond its said overshoot position said cam assembly is permitted to slide laterally a distance to disengage said piston from said block, whereby said piston cylinder and piston may be disengaged from said housing for cleaning or replacement.

8. A mechanism for removably connecting a piston rod to a sliding member within a pipette, comprising:

a connection block framed as part of said sliding member, said connection block including substantially orthogonal apertures therein, one receiving an end of a piston rod assembly and the other having a sliding cam assembly therein, said substantially orthogonal apertures intersecting, said cam assembly including a cam follower at one end thereof, resilient means urging said cam follower out of said block aperture to engage a cam surface and a plunger carried within said cam assembly in a position to engage a cooperatively shaped notch at the end of the piston rod assembly for holding it within its said aperture, and a cam surface extending along the path of said slide and having two surfaces, a first of which positions said cam follower so that its said plunger engages the piston slot and another cam surface position wherein said cam follower moves with respect to said block to cause said plunger to disengage from said piston rod assembly slot, thereby permitting removal of said piston rod.

9. The mechanism according to claim 8 that additionally comprises:

a pin attached to said cam follower assembly and extending outward of said block on an opposite side thereof from said cam follower, said pin thereby to move back and forth as said cam follower so moves in response to changes in said cam surface, said plunger being slidably retained within said cam assembly and resiliently urged against said piston rod for engagement thereof, and a third cam surface intermediate of said two cam surfaces, said plunger being held in engagement with said piston rod groove as said cam follower moves from the first cam surface to the second cam surface, thereby to provide said pin at three positions relative to said block depending upon the cam surface contacted by said cam follower, whereby said pin may selectively be utilized as an abutment for moving said slide when said cam follower is in certain of its positions.

10. A liquid dispensing device of a type comprising within a housing a liquid chamber having a liquid passage thereinto and mechanical means connected therewith for changing the liquid volume of said chamber, thereby to discharge liquid through said passage upon reducing said chamber volume, an improvement in said chamber volume changing means, comprising:

a linear rack within said housing held to slide back and forth along a straight line path, said rack being connected as part of said volume changing means to cause the chamber volume to be reduced when said rack is moved in one direction, a rod held within said housing and constrained to move back and forth in a straight line path parallel to and adjacent said rack path, one end of said rod extending through said housing and terminating in a knob, a resilient element normally urging said rod in a direction outward of said housing a distance limited by a stop, a pawl hingedly attached within the housing to the other end of said rod and adapted for normally engaging a tooth of said rack for moving the rack in response to depression of said knob toward said housing, means attached as part of said housing for providing an abutment of an end of said pawl, thereby providing a limit stop to the movement of said knob, rod and pawl assembly into the housing, and a cam surface attached to the housing in a position between said parallel paths adapted to cause said pawl to pivot about its hinge away from said rack when said rod is in its resiliently urged rest position but which guides said pawl into said engagement with said rack as said knob is depressed.

11. The improved liquid dispensing device according to claim 10 wherein said surface is provided as a rounded end of a wall positioned between said rack and rod parallel paths, said pawl being shaped triangularly in a manner to extend into said rack at a position beyond the end of said wall.

12. The improved liquid dispensing device according to claim 10 which additionally comprises within said housing a puck resiliently urged against said linear rack in a manner to provide drag against its movement, the amount of said drag being selected to prevent said rack from moving backwards as said pawl is disengaged therefrom.

13. The improved liquid dispensing device according to claim 10 wherein said stop includes a wall positioned orthogonally to the rack and rod paths, and further wherein the wall contacting end of said pawl includes two spaced apart feet.

14. The improved liquid dispensing device according to claim 13 wherein said pawl is spring loaded in a direction to rotate about its hinge towards said rack, and further wherein said device additionally comprises a puck resiliently urged against said rack for providing frictional drag thereon, the amount of such drag and the amount of pawl rotating spring load being such that the foot on the end of the pawl furthest removed from said rack engaging tip of the pawl first engages said wall to be followed by such an engagement by the other of said feet, whereby backward movement of said rack from rotation of said pawl about said hinge is avoided.

15. A pipette having a detachable piston assembly, comprising:

an elongated pipette body having a knob extending from one end thereof, a piston cylinder structure having a piston entering one end thereof, an end of said piston cylinder at said one end having in a plane substantially perpendicular to an axis of said cylinder and said piston a plurality of circular flange segments arranged around an outside circular end surface thereof with spaces therebetween, means within the pipette body for operably connecting said knob and said piston, and means held against rotation at another end of said pipette body but axially movable with respect thereto for clamping said piston cylinder flange segments to said another end of the pipettor body, said clamping means including a ring with a maximum inside diameter sufficient to receive the piston cylinder circular flange segments therethrough and said ring additionally comprising internally extending circular flanges having a radial extent and shape to fit in the spaces between the flanges of the piston assembly, whereby said piston assembly is installed by moving its external flanges into spaces between the internally extending flange members, and then urging said clamping member against said another pipette end surface to securely hold the piston flanges against the pipette body.

16. The pipette according to claim 15 wherein said clamping means comprises:

a washer forming the ring and internally extending circular flanges, said washer additionally including a plurality of tabs extending from said ring in an axial direction, said tabs being received within mating apertures of said another end of the pipette body, thereby to prevent rotation of said washer while permitting axial movement thereof, and a collar threadedly attached to the end of the pipette body, said collar being shaped for receiving said piston cylinder structure therethrough and for holding the ring at a position with its feet extending into said pipette body apertures.

17. A detachable pipette piston assembly, comprising:

a piston cylinder structure having at one end thereof an adapter for connecting a tip thereto for providing fluid communication between said piston cylinder and the internal portion of said tip, a piston rod assembly adapted for insertion of one end thereof through an opening of said piston cylinder at another end thereof, a piston seal at said another end of the piston cylinder, a plurality of circular flange segments extending from a circular outside surface of said piston cylinder structure at another end thereof with an axis of said cylinder being the center of curvature of said flange segments and said outside surface structure, said flanges lying in a plane substantially perpendicular to said axis, said flanges additionally being equally spaced around a circle in said plane and having edges on radial lines from said center of curvature forming spaces between said flanges, and a groove surrounding a circumference of said piston rod assembly adjacent another end thereof, thereby permitting connection thereof to operating mechanisms within the pipette.

* * * * *